United States Patent [19]

Huon de Kermadec

[11] Patent Number: 4,785,739

[45] Date of Patent: Nov. 22, 1988

[54] TRACKED TRANSPORTATION SYSTEM COMPRISING EMERGENCY CAR BRAKING SYSTEM

[75] Inventor: Jean Huon de Kermadec, Le Chesnay, France

[73] Assignee: Soule, Bagneres de Bigorre, France

[21] Appl. No.: 926,557

[22] Filed: Nov. 4, 1986

[30] Foreign Application Priority Data

Nov. 5, 1985 [FR] France ..... 85 16360

[51] Int. Cl.[4] ..... B61B 9/00; B61B 12/12; B61K 7/20; B61F 1/00

[52] U.S. Cl. ..... 104/208; 104/229; 104/259; 105/216; 105/453

[58] Field of Search ..... 105/238.1, 329.1, 148, 105/330, 465.1, 216, 217, 453, 463.1; 104/208, 226, 229, 173.1, 165, 259, 260, 249; 188/41, 57

[56] References Cited

U.S. PATENT DOCUMENTS

| | | | |
|---|---|---|---|
| 3,848,728 | 11/1974 | Lelbrick et al. | 198/155 |
| 4,062,295 | 12/1977 | Hamann | 105/216 X |
| 4,512,259 | 4/1985 | Huon de Kermadec | 104/208 |

FOREIGN PATENT DOCUMENTS

| | | |
|---|---|---|
| 2927494 | 1/1981 | Fed. Rep. of Germany . |
| 2216155 | 8/1974 | France . |
| 2350236 | 12/1977 | France . |
| 8102275 | 8/1981 | PCT Int'l Appl. . |
| 475074 | 11/1937 | United Kingdom . |
| 1584951 | 2/1981 | United Kingdom . |
| 2091360 | 7/1982 | United Kingdom . |

*Primary Examiner*—Johnny D. Cherry
*Assistant Examiner*—Joseph D. Pape
*Attorney, Agent, or Firm*—Perry Carvellas

[57] ABSTRACT

In a tracked transportation system independent cars are drawn along by a common cable. A car comprises a rolling chassis with a cabin suspended above the chassis by a set of chains. The chains are coupled to a shaft forming apparatus for weighing the cabin and connected to an assembly for gripping the cable. The coupling between the chains and the gripping assembly can be released by a trigger device fixed to the track and operated by remote control to lower the cabin relative to the chassis and so achieve emergency braking.

19 Claims, 3 Drawing Sheets

TRACKED TRANSPORTATION SYSTEM COMPRISING EMERGENCY CAR BRAKING SYSTEM

BACKGROUND OF THE INVENTION

1. Field of the Invention

The invention concerns a tracked transport system, for example a railroad or like system, utilizing one or a plurality of cars on a route in the order of a few hundred meters and in which the one car or each car is driven along a guide track by a cable, a conveyor, conveyor belts or like means; the invention is more particularly concerned with an improvement to a known type of car designed for such utilization and making it possible to achieve reliable emergency braking when necessary.

2. Description of the Prior Art

U.S. Pat. No. 4,512,259 describes a transport system using a car or cars able to accommodate a limited number of passengers (in the order of ten passengers, for example) and designed to convey passengers over average distances in the order of a few hundred meters.

In a system of this kind a cable is driven in a closed loop along the track at all times and the car or cars are temporarily attached to it by appropriate gripping means in order to be drawn from one point to another.

In the abovementioned prior art document the force applied by the gripping means to the cable reflects the load in the car, so that the starting up of its movement is always subjectively experienced in the same way, in particular with the same acceleration, however many passengers may have entered the car. To achieve this, the car or each car is in two parts, respectively a rolling chassis adapted to move along the track and a cabin suspended from the chassis by a set of suspension members attached to a load summing mechanism forming weighing means. This mechanism is also coupled to the cable gripping means so that the gripping force developed by the latter is representative of the load in the cabin, that is to say the number of passengers on board. This arrangement ensures a gradual starting up the car when the gripping means (in the form of braked pulley wheels movable towards each other) close around and grip the cable. When the car arrives at a station the gripping means are released by the action of a cam operating a lever fastened to them and the car is slowed down when one or more braked wheels of the car enter into frictional contact with a succession of decelerator belts running at progressively slower speeds.

According to an advantageous feature of the prior art system, the means for braking the wheels are also coupled to the load summing mechanism forming the weighing means so that the deceleration of the car is substantially independent of the load in the cabin.

This system functions in an entirely satisfactory manner, but if consideration is given to operating it under quasi-automatic conditions, or even without human supervision, a number of safety devices are needed and in particular emergency braking means operated whenever abnormal operation is detected.

The present invention proposes an improvement of this type providing extremely reliable emergency braking, this improvement being advantageously combined with the structure of the car as defined hereinabove and in particular with the aforementioned weighing means.

SUMMARY OF THE INVENTION

In one aspect, the invention consists in a transportation system comprising a track, at least one car adapted to be driven along the track and comprising a chassis adapted to roll on the track and a cabin, suspension members whereby the cabin is suspended from the chassis, braking means on a lower part of the cabin, and means on the cabin adapted selectively to release the suspension members to cause lowering of the cabin and operation of the braking means.

When the cabin or each cabin is driven by a cable or the like circulating along the track the aforementioned suspension members are preferably attached to a load summing mechanism forming weighing means, this mechanism being coupled to cable gripping means fastened to the car so that the force exerted by said gripping means is representative of the loads transmitted to the load summing mechanism.

The invention further consists in a specific embodiment of a load summing mechanism of this kind well suited to implementing also the required safety device function. Thus this mechanism comprises a transverse shaft rotatably mounted on the chassis and to the ends of which are fixed winding means for the aforementioned suspension members. These are wound onto the corresponding winding means with two suspension members at each end of the shaft in such a way that the moments of the resulting torques combine additively. A sleeve is disposed coaxially to the shaft and a releasable coupling mechanism is provided between the shaft and the sleeve in order to fasten them together when the cable gripping means are coupled to the sleeve in such a way as to exert on it a torque balancing the total torque exerted on the shaft by the action of the suspension members when the sleeve is fastened to the shaft. If necessary, the coupling between the shaft and the sleeve is broken by a selectively operable triggering device situated on the track whereupon the cabin, no longer suspended, is lowered and stops within a relatively short distance because the decoupling of the shaft and the sleeve also releases the gripping means holding the cable.

The invention will be better understood and other advantages of the invention will emerge more clearly from the following description of a preferred embodiment of a system in accordance with the invention given by way of example only and with reference to the accompanying drawings.

DESCRIPTION OF THE PREFERRED EMBODIMENT

Figure 1:
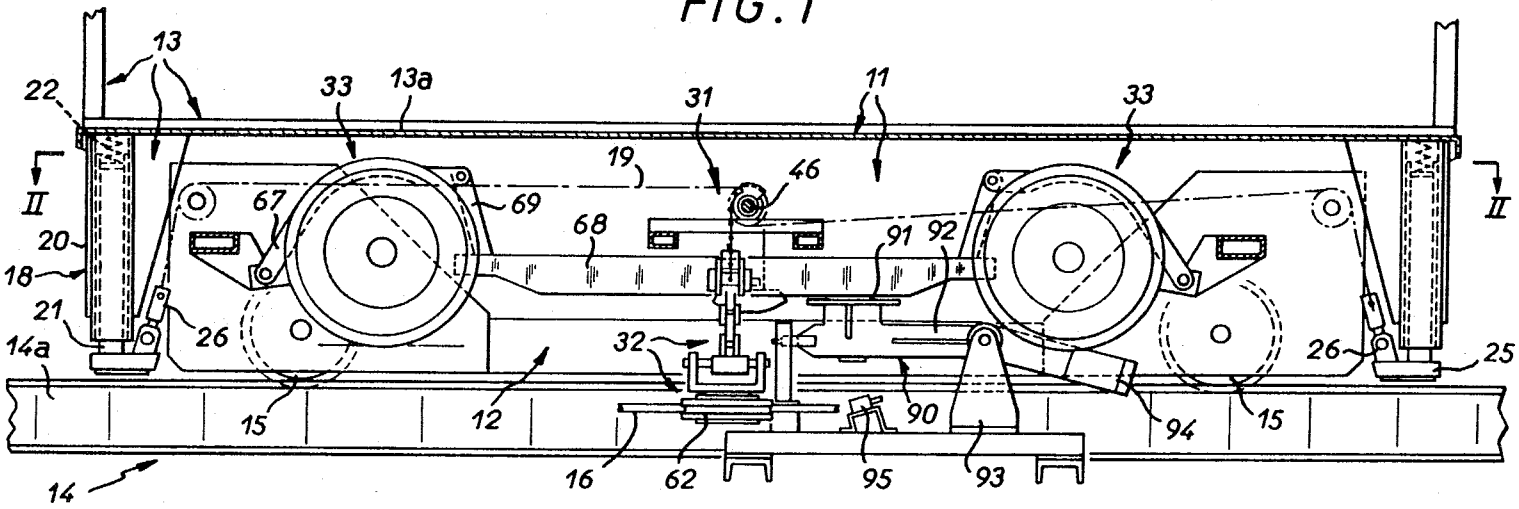
FIG. 1 is a schematic view in elevation of the lower part of the car showing in particular the chassis rolling on the track, this view corresponding to a cross-section on the line I—I in FIG. 2.

With reference to the drawings, there is shown a car 11 consisting of a rolling chassis 12 above which is a cabin 13 of which only the lower part is indicated. The cabin 13 is suspended from the chassis 12 by a mechanism to be described in more detail later. The chassis 12 moves along a railroad type track 14 (in this instance consisting of two I-section rails 14*a*) on four metal wheels 15. A traction cable 16 moves continuously along the track 14, between the rails, in a closed loop. It is driven by a motor situated in one station, for example, and guided by sets of pulley wheels, especially in curves; all these components are conventional and none are shown in the drawings. Four upright members 18 are fixed under the floor 13*a* of the cabin and serve as an anchor structure for suspension members 19 whereby the cabin is suspended from the chassis. These suspension members may be cables, but in the example now being described they are advantageously chains. Each vertical upright member has a telescopic structure, comprising a tubular portion 20 fastened to the cabin inside which is a longitudinally movable member 21. A damper spring 22 is disposed between the end of the tubular portion 20 and the inside end of the member 21. This arrangement thus confers some degree of vertical elasticity on the suspension of the cabin. The lower ends of the upright members 18, to be more precise in this specific instance the ends of the members 21, comprise horizontal base members 25 carrying anchor yokes 26 for the ends of the suspension members 19 attached to the cabin 13.

In the example shown and in accordance with a major feature of the invention the base members 25 thus constitute four brake skids and to this end are disposed above the rails of the track 14. These skids are therefore adapted to enter into frictional contact with the rails if the cabin 13 is lowered relative to the rolling chassis 12. The bottom surfaces of the base members 25 may be surfaced with an appropriate friction material so as to halt the car within a predetermined distance so that the deceleration is tolerable for the passengers. A friction material of the type used in automobile vehicle brakes gives good results, for example.

Figure 4:
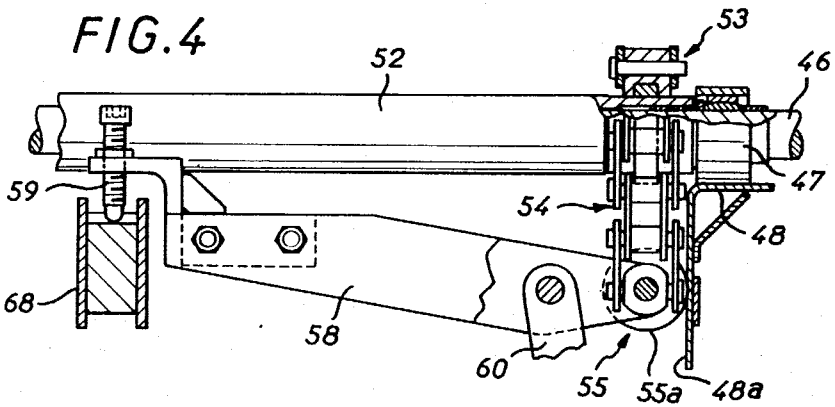
FIG. 4 is a detail view as seen in the direction of the arrow IV in FIG. 2.
Figure 3:
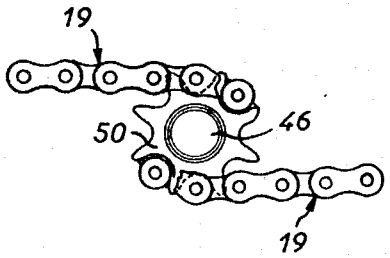
FIG. 3 is a detail view as seen in the direction of the arrow III in FIG. 2.

There will now be described in more detail the rolling chassis 12 and the suspension means for the cabin incorporated in it. The chassis comprises an infrastructure forming a sort of frame 30 carrying in particular the wheels 15, a load summing mechanism 31 forming weighing means, means 32 for gripping the cable 16 and two braked wheels 33 situated in a common vertical plane. To be more precise, the frame 30 comprises two longitudinal members 35 parallel to the rails and linked by crossmembers 36, 37, 38 and 39. Each longitudinal member 35 comprises a tubular median section 40 to the ends of which are welded plates defining wide yokes 41, 42. Each yoke supports one of the wheels 15 and a sprocket wheel 45 onto which is wound the chain 19 connected to one of the upright members 18 (that nearest the yoke) of the cabin 13. Thus each chain extends approximately horizontally and parallel to the track from the corresponding sprocket wheel 45 to the load summing mechanism 31 located approximately at the center of the chassis. This mechanism comprises a transverse shaft 46 at the ends of which are mounted winding means for end portions of the chains 19. The shaft 46 is rotatably mounted in bearings 47 fixed to supports 48 in turn mounted between the two central crossmembers 37 and 38. In this instance the winding means comprise two sprocket wheels 50 fixed to the respective ends of the shaft 46 and at the periphery of which are defined the anchor points for the aforementioned suspension members, in the ratio of two suspension members (that is to say two chains 19) per sprocket wheel. The chains are wound onto the sprocket wheels 50 in such a way that the moments of the resulting torques combine additively. To be more precise, the arrangement is as shown in FIG. 3 which shows that two chains 19 corresponding to the two upright members situated on the same side of the track are fixed (welded, for example) by their last link to diametrically opposite points on the corresponding sprocket wheel 50 and are wound partially around the latter so as to be stretched between the sprocket wheel 50 and the corresponding sprocket wheels 45 around which they are wound and then attached to the corresponding upright members 18 at the bottom. The same arrangement is found at each end of the shaft and the chains are therefore wound in the ratio of two per sprocket wheel in directions such that the moments of the four torques combine additively, that is to say tend to rotate the shaft 46 in the same direction. It is to be understood that the lengths of the chains are determined so that when the shaft 46 is maintained in a particular angular position (that of FIG. 3, for example) the cabin is suspended from the rolling chassis and so that, when the shaft 46 is released, the cabin 13 rests on the rails 14*a* through the base members 25 serving as brake skids. The load summing mechanism that has just been described thus constitutes a means of weighing the cabin 13 and the forces transmitted by the chains 19 are balanced by the cable gripping means 32 (and also by a mechanism for actuating braked wheels 33) so that the shaft 46 is normally held in an angular position such that the chains are taut and the cabin 13 is suspended from the rolling chassis 12. The coupling between the shaft 46, the gripping means 32 and the mechanism actuating the braked wheels 33 is achieved by means of a sleeve 52 carried by and coaxial with the shaft 46. A sprocket wheel 53 is fixed (welded, for example) to the sleeve 52 (see FIG. 4) and a section of chain 54 is wound around this sprocket wheel in a direction such that a force applied to the chain tends to turn the sleeve in a direction opposite that in which the shaft 46 is urged by the chains 19. The other end of this section of chain 54 is fixed to a mobile abutment member 55 with rollers 55*a* rolling on a fixed vertical surface 48*a* of an adjacent support 48. A transmission arm 58 is pivoted at one end to the movable abutment member 55. This arm, substantially parallel to the shaft 46, terminates in an adjustable plunger member 59 and a link 60 forming part of a control mechanism (not shown) for the means 32 for gripping the cable 16 is pivoted to the same arm in the vicinity of the mobile abutment member 55. The cable gripping means essentially comprise two grooved pulley wheels 62 adapted to bear on each other through their edges and gripping the cable 16. It will be understood that with this arrangement the force with which the cable is gripped is representative of the load in the cabin, so that the acceleration imparted to the car on leaving a station is perfectly controled irrespective of the number of passengers. When the cabin enters a station a lever of the gripping mechanism (not shown) is actuated by a ramp fixed along the track so as to decoupling the car from the traction cable. The two braked wheels 33 project cantilever fashion from the respective crossmembers 36 and 39 through the intermediary of yokes 64 in which are pivoted hub supports 65. A brake drum 66 is mounted coaxially with each wheel. A curved arm 67 carrying a friction facing is pivoted to each yoke 64 in such a way that the friction facing can come into contact with the adjacent drum. The braking force is transmitted by a longitudinal arm 68 disposed to float between the other ends of the arms 67 by means of respective links 69, the plunger 59 being supported at the middle of its longitudinal arm 68. The braked wheels 33 are fitted with pneumatic tires and are adapted to come into contact in a station with a braking strip 70 (outlined in chain-dotted line in FIG. 2) circulating at lower speed after disconnection of the cable gripping means, as already indicated. The car is thus braked by the wheels 33 until it is immobilized on the belt 70 which then conveys the car at its own speed. Once again, it emerges from the foregoing description that the braking force exerted on the drum 66 is representative of the load in the cabin, so that deceleration of the cabin may be better controlled, irrespective of the number of passengers.

It is to be understood that normal functioning of the system as just described hereinabove in relation to gripping the cable on leaving a station and normal braking of the car on arriving in a station presupposes that the shaft 46 and the sleeve 52 are prevented from rotating.

Figure 2:
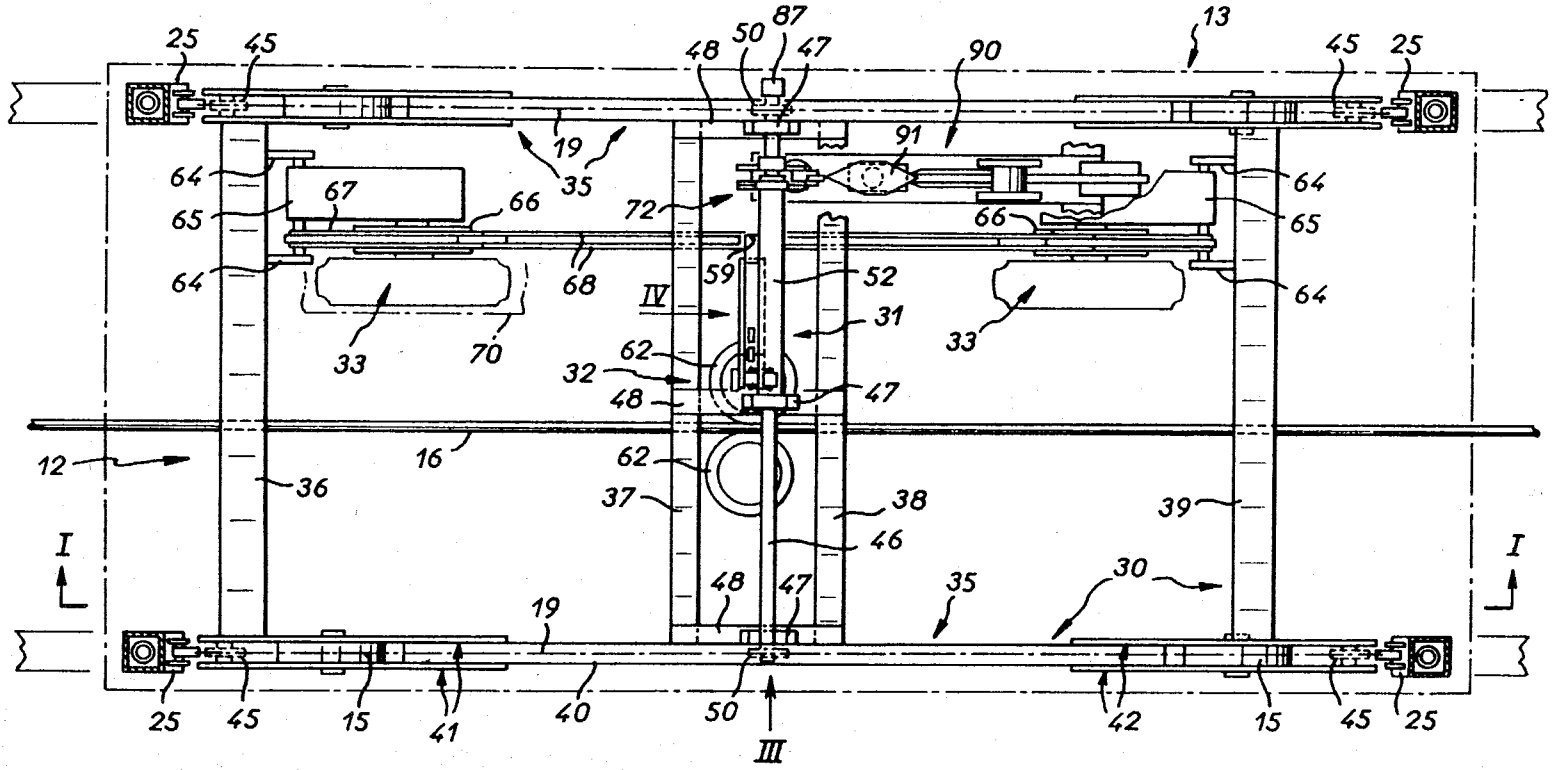
FIG. 2 is a plan view showing the principal components of the rolling chassis, this view corresponding to a cross-section on the line II—II in FIG. 1.
Figure 6:
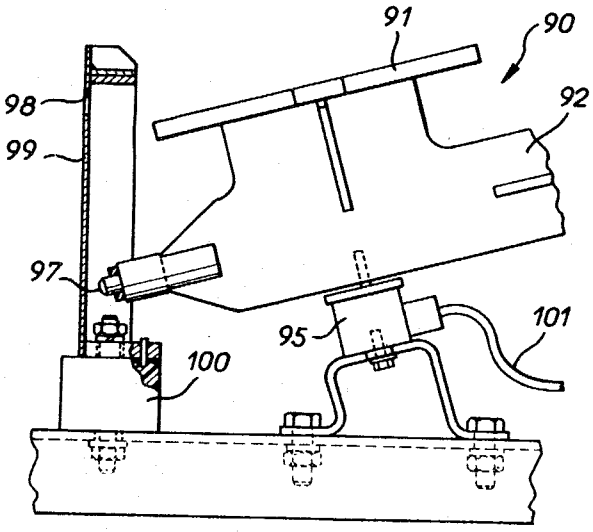
FIG. 6 is a detail view to a larger scale of a trigger device adapted to cooperate with the coupling mechanism from FIG. 5.
Figure 5:
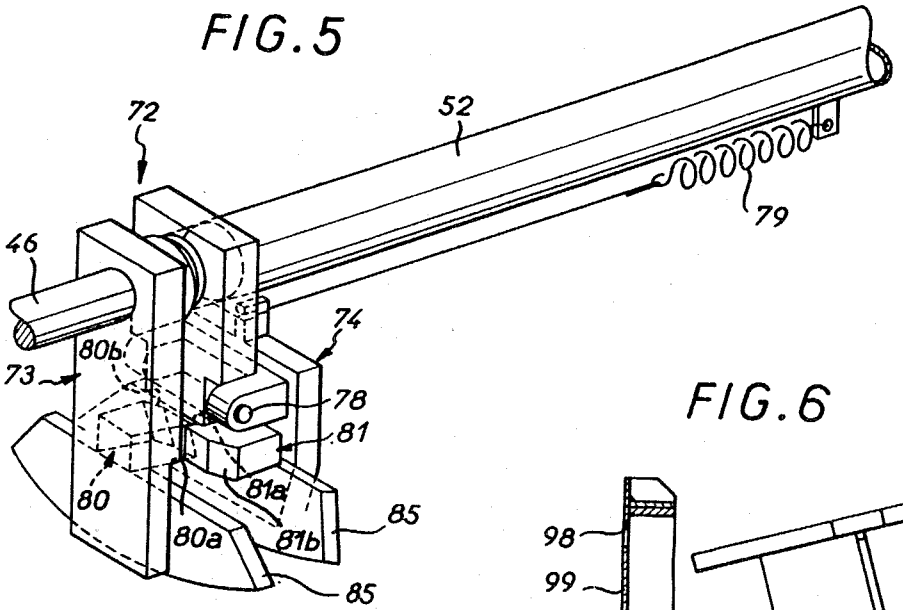
FIG. 5 is a detail view in perspective of a mechanism for coupling together a shaft and a sleeve.

In accordance with one important feature of the invention the shaft and the sleeve may be selectively decoupled from each other and thus constitute means for releasing the aforementioned suspension members 19 and adapted, when operated, to bring about lowering of the cabin 13 resulting in the application of the emergency braking system consisting in this instance of the base members 25 which are brought into contact with the rails 14*a*. For this purpose a releasable coupling mechanism 72 visible in FIG. 5 is provided between the shaft 46 and the sleeve 52 so as to constrain them to rotate together during normal operation. This mechanism 72 comprises two levers 73 and 74 respectively fastened to the shaft 46 and the sleeve 52 and situated near each other in the vicinity of one end of the sleeve. At least one of the levers, in this instance the lever 74 fastened to the sleeve, is pivoted on a pin 78 perpendicular to the sleeve and urged by a spring 79 towards a predetermined position in the direction of the other lever. The levers carry respective lateral abument members 80 and 81 in face-to-face relationship with each other enabling them to be constrained to rotate together when these abutment members are in contact through their surfaces 80*a* and 81*a*. In this position the abutment members are held in contact by the opposed torques exerted on the shaft 46 and on the sleeve 52, the twofold consequence of which is to cause the shaft and the sleeve to rotate together and to immobilize them in a specific position determined by the equilibrium which is established between the taut chains 19 and 54. The ends of the levers 73, 74 are provided with engagement flanges 85 which are substantially in face-to-face relationship with each other when the abutment members 80, 81 are in contact. This is the situation shown in FIG. 5. The two flanges are held facing each other with a predetermined distance between them by virtue of the fact that the contacting surfaces of the abutment members 80 and 81 are slightly slanted relative to each other. These abutment members further comprise inclined rear faces 80*b* and 81*b* which slide against each other and push back the mobile lever 74, against the action of the spring 79, when the system is "reset" by moving the flanges 85 together, this maneuver being accomplished by turning the shaft 46 by means of a drive square 87 situated at one end of it. One or more selectively operable trigger devices 90 are provided along the track in such a way that an upper part forming a cam 91 of a trigger device of this kind may be inserted between the engagement flanges 85 when a car passes by in order to move apart the abutment members 80 and 81 and consequently to decouple the shaft 46 and the sleeve 52. Relative rotation between these two parts simultaneously lowers the cabin and releases the gripping means 32, which brings about emergency braking to halt the car after a few meters. A trigger device of this kind is shown in FIGS. 1 and 2 in the operative position, that is to say with the cam 91 raised and on the point of pushing apart the engagement flanges 85, and in FIG. 6 in the inoperative position, when the cam is too low to reach the engagement flanges. To be more precise, the trigger device 90 comprises a rocker arm 92 pivoted to a base 93 fixed to the track. This rocker arm carries the cam forming member 91 at one end and a counterweight 94 at the other end. The counterweight is sufficiently heavy to tilt the rocker arm so as to raise the cam 91. However, an "electromagnetic sucker" type control device 95 cooperates with the arm of the rocker arm that carries the cam to hold it in a low position when it is energized. Interruption of the electrical power supply to the control device causes the rocker arm to tilt due to the action of the counterweight and raises the cam 91 to the level of the trajectory of the engagement flanges. One end of the rocker arm is provided with a locking peg 97 which is inserted at the end of the swinging movement into a housing 98 provided on a vertical upright member 99 fixed to the track. The peg and/or the upright member are provided with elastic retraction means to facilitate interlocking of the peg with the housing. To be more precise, the peg 97 is mounted to move longitudinally in a bore and against the action of a spring urging it outwardly whereas the upright member 99 is mounted on a block 100 of elastically deformable material such as rubber. An electrical power supply system 101 for the control device or devices 95 is controled by a supervisory system responsive to the speed of the car or cars and/or the relative speed of at least two cars. This supervisory system does not form part of the invention and will therefore not be described in detail. It may consist of a plurality of sensors appropriately disposed along the track. There is particular advantage in monitoring the speed of a car on a slope. This speed may be greater than the normal speed if the cable gripping means are defective. The emergency braking procedure could be triggered in this case by measuring the speed of the car and commanding actuation of a trigger member 90 situated at the entry to a station. The supervisory system may also be designed to monitor the distances between cars in between stations by means of a block apparatus as conventionally used on railroads and to respond to any fault condition by causing tilting of one or more trigger devices appropriately disposed along the track.

Figure 7:
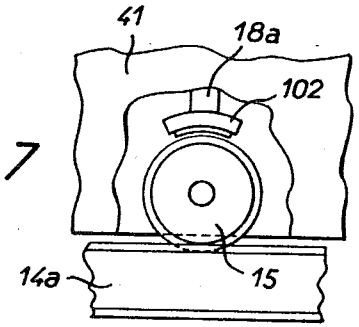
FIG. 7 is a detail view showing one possible embodiment of emergency braking means provided between the cabin and the rolling chassis of the car.

FIG. 7 shows an alternative braking means. In this embodiment upright members 18*a* fastened to the cabin and carrying friction facings 102 are no longer combined with the suspension means for the cabin but are situated above the wheels 15 of the rolling chassis. Given these conditions, lowering of the cabin brings about emergency braking but this is applied to the wheels 15 and not to the rails 14*a*.

The system that has just been described operates in an extremely simple way that clearly emerges from the foregoing description. If for any reason the supervisory system associated with the track detects abnormal operating conditions it produces control signals leading to tilting of one or more rocker arms 92 and consequently raising of the corresponding cams 91. Note that the approximately losenge-shape profile of each cam 91 (see FIG. 2) and above all the fact that the rocker arm 92 is locked in the raised position by virtue of the cooperation between the peg 97 and the adjacent upright member 99 authorizes effective action on the coupling mechanism whatever the direction of movement of the car. Thus the system is also capable of stopping a car running backwards down a slope.

It is to be understood that the invention is open to numerous variations. As mentioned hereinabove, the tractor cable may be replaced by a conveyor or conveyor belts and, generally speaking, the means for driving the cars may be independent of the suspension members whereby the cabin is suspended above the rolling chassis. Also, the invention encompasses any means or arrangement adapted to bring about releasing of these suspension members to procure braking.

There is claimed:

1. Transportation system comprising a track, at least one car adapted to be driven along said track and comprising a chassis adapted to roll on said track and a cabin, suspension members whereby said cabin is suspended from said chassis, braking means on a lower part of said cabin, and release means on said cabin, said suspension members are attached to a load summing mechanism incorporating said release means and said release means is adapted to release said suspension members and to cause lowering of said cabin and operation of said braking means.

2. Transportation system according to claim 1, wherein said load summing mechanism comprises a transverse shaft rotatably mounted on said chassis, winding means adapted to have said suspension members wound on them, respective upright members fastened to said cabin and between which an anchor point at the periphery of said winding means said suspension members extend, there being at least two suspension members for each end of said shaft wound on said winding means in such a way that the moments of the resulting forces combine additively.

3. Transportation system according to claim 2, wherein said suspension members are chains and said winding means comprise sprocket wheels fixed to the ends of said shaft, corresponding ends of said chains being fixed to said sprocket wheels.

4. Transportation system according to claim 2, further comprising a sleeve coaxial with said shaft and a releasable mechanism for selectively coupling said sleeve to said shaft.

5. Transportation system according to claim 4, wherein said coupling mechanism comprises levers disposed side by side and fastened respectively to said shaft and to said sleeve, at least one of which levers is pivoted, spring means urging said at least one lever towards the other lever, lateral abutment members on said levers whereby they may be constrained to rotate together, said abutment members being adapted to be held in contact with each other by oppositely directed torques exerted on said shaft and on said sleeve, respective engagement flanges on said levers in substantially face-to-face relationship with each other when said abutment members are in contact with each other, selectively operable trigger means disposed on said track, and a cam member on said trigger means disposed to pass between said engagement flanges when said vehicle passes by so as to separate said abutment members and thereby decouple said shaft and said sleeve and so lower said cabin.

6. Transportation system according to claim 5, wherein said trigger means comprise a rocker arm, a base fixed to said track and to which said rocker arm is pivoted, said rocker arm carrying said cam-forming member at one end and a counterbalance at its other end, and an electrical control device cooperating with an arm of said rocker arm so as to hold said cam-forming member in a low position when it is energized, whereby de-energizing said control device results in tilting of said rocker arm due to the action of said counterweight into a position raising said cam-forming member to the level of the trajectory of said engagement flanges.

7. Transportation system according to claim 6, wherein one end of said rocker arm is provided with a locking peg further comprising an upright member fixed to the track which has on it a housing into which said peg is inserted at the end of said tilting movement, said peg and/or said upright member being provided with elastic retraction means whereby said peg may be interlocked with said housing.

8. Transportation system according to claim 6, further comprising a supervisory system adapted to control energization of said control device and responsive to the speed of the car or the cars and/or the distance between two adjacent cars.

9. Transportation system according to claim 1, wherein said cabin comprises upright members under its floor and above said track to which brake skids are attached, whereby lowering said cabin causes said brake skids to enter into frictional contact with said track.

10. Transportation system according to claim 1, wherein said lower part of said cabin comprises at least four brake skids and said chassis comprises a plurality of wheels and each of said brake skids is disposed above a respective wheel whereby lowering of said cabin brakes said wheels.

11. Transportation system comprising a track, at least one car adapted to be driven along said track and comprising a chassis adapted to roll on said track and a cabin, said car is driven by a cable or the like circulating along said track and said car carries cable gripping means, suspension members whereby said cabin is suspended from said chassis, said suspension members are attached to a load summing mechanism, said load summing mechanism is coupled to said cable gripping means in such a way that the force exerted by said cable gripping means is representative of the loads transmitted to said load summing mechanism, braking means on a lower part of said cabin, and release means on said cabin adapted to release said suspension members and to cause lowering of said cabin and operation of said braking means.

12. Transportation system according to claim 11, further comprising a sleeve coaxial with said shaft and a releasable mechanism for selectively coupling said sleeve to said shaft, wherein said cable gripping means are coupled to said sleeve in such a way as to apply thereto a torque balancing, the total torque exerted on said shaft due to the action of said suspension members when said sleeve is fastened to said shaft, whereby separation of said shaft and said sleeve simultaneously lowers said cabin and releases said gripping means.

13. Transportation system according to claim 12, wherein said car further comprises at least one braked wheel for stopping said car normally in stations and further comprising a mechanism controlling braking of said at least one braked wheel connected to said sleeve so as to develop a braking force representative of the loads transmitted to said load summing mechanism when said sleeve and said shaft are coupled together.

14. Transportation system according to claim 11, wherein said coupling mechanism comprises levers disposed side by side and fastened respectively to said shaft and to said sleeve, at least one of which levers is pivoted, spring means urging said at least one lever towards the other lever, lateral abutment members on said levers whereby they may be constrained to rotate together, said abutment members being adapted to be held in contact with each other by oppositely directed torques exerted on said shaft and on said sleeve, respective engagement flanges on said levers in substantially face-to-face relationship with each other when said abutment members are in contact with each other, selectively operable trigger means disposed on said track, and a cam member on said trigger means disposed to pass between said engagement flanges when said vehicle passes by so as to separate said abutment members and thereby decouple said shaft and said sleeve and so lower said cabin, and wherein said cable gripping means are coupled to said sleeve in such a way as to apply thereto a balancing torque, the total torque exerted on said shaft due to the action of said suspension members when said sleeve is fastened to said shaft, so that separation of said shaft and said sleeve simultaneously lowers said cabin and releases said gripping means.

15. Transportation system according to claim 11, wherein said cabin comprises upright members under its floor and above said track to which brake skids are attached, whereby lowering said cabin causes said brake skids to enter into frictional contact with said track.

16. Transportation system according to claim 11 wherein said lower part of said cabin comprises at least four brake skids and said chassis comprises a plurality of wheels and each of said brake skids is disposed above a respective wheel whereby lowering of said cabin brakes said wheels.

17. Transportation system comprising a track, at least one car adapted to be driven along said track and comprising a chasis adapted to roll on said track and a cabin, suspension members whereby said cabin is suspended from said chasis, said chasis comprising a plurality of wheels, braking means on a lower part of said cabin comprising at least four brake skids, each of said brake skids being disposed above a respective wheel, release means on said cabin adapted to release said suspension members and to cause lowering of said cabin and operation of said braking means to brake said wheels and means to trigger said release means.

18. Transportation system comprising a track, at least one car adapted to be driven along said track and comprising a chasis adapted to roll on said track and a cabin, suspension members whereby said cabin is suspended from said chasis, braking means on a lower portion of said cabin comprising at least four brake skids, said cabin comprising upright members under its floor and above said track to which said brake skids are attached, said upright members carry means coupled to said cabin for anchoring said suspension members, release means on said cabin adapted to release said suspension members and to cause lowering of said cabin and operation of said braking means causing said brake skids to enter into frictional contact with said track and means to trigger said release means.

19. Transportation system according to claim 18, wherein each of said upright members is telescopic and accommodates a damper spring.

* * * * *